US007322493B2

(12) United States Patent
Skillin

(10) Patent No.: US 7,322,493 B2
(45) Date of Patent: Jan. 29, 2008

(54) DISPENSING CLOSURE HAVING COMPLETE PERIPHERAL SEAL

(75) Inventor: Clifford Skillin, Blackstone, MA (US)

(73) Assignee: Polytop Corporation, Slatersville, RI (US)

( * ) Notice: Subject to any disclaimer, the term of this patent is extended or adjusted under 35 U.S.C. 154(b) by 353 days.

(21) Appl. No.: 10/960,179

(22) Filed: Oct. 7, 2004

(65) Prior Publication Data

US 2005/0087550 A1 Apr. 28, 2005

Related U.S. Application Data

(60) Provisional application No. 60/587,518, filed on Jul. 13, 2004, provisional application No. 60/509,523, filed on Oct. 9, 2003.

(51) Int. Cl.
*B67D 3/00* (2006.01)

(52) U.S. Cl. ..... 222/517; 220/837

(58) Field of Classification Search ..... 222/153.14, 222/498, 517, 518, 556, 557; 220/860–893, 220/837–839; 215/289, 235, 236
See application file for complete search history.

(56) References Cited

U.S. PATENT DOCUMENTS

| | | | | | |
|---|---|---|---|---|---|
| 4,010,875 | A * | 3/1977 | Babiol | 222/517 |
| 4,158,902 | A * | 6/1979 | Chernack et al. | 16/227 |
| 4,573,600 | A * | 3/1986 | Dubach | 215/237 |
| 4,635,823 | A | 1/1987 | Stull | 222/108 |
| 4,917,253 | A | 4/1990 | Dutt | |
| 5,088,612 | A * | 2/1992 | Storar et al. | 215/247 |
| 5,271,536 | A * | 12/1993 | Wilson | 222/498 |
| 5,437,383 | A | 8/1995 | Stull | 215/235 |
| 5,938,087 | A | 8/1999 | Randall | 222/547 |
| 6,116,477 | A | 9/2000 | Kreiseder et al. | 222/556 |
| 6,305,563 | B1 | 10/2001 | Elliott | 215/235 |
| 6,478,184 | B2 * | 11/2002 | Berge et al. | 220/831 |
| 6,766,926 | B1 * | 7/2004 | Elchert | 222/498 |
| 2002/0096532 | A1 | 7/2002 | Berge et al. | 220/831 |

FOREIGN PATENT DOCUMENTS

| | | |
|---|---|---|
| DE | 76 31 199 U1 | 1/1977 |
| EP | 1 386 849 A1 | 4/2004 |
| GB | 207638 | 12/1923 |

* cited by examiner

*Primary Examiner*—Lien M. Ngo
(74) *Attorney, Agent, or Firm*—Barlow, Josephs & Holmes, Ltd.

(57) ABSTRACT

A dispensing closure for a container comprising a closure body adapted to be mounted on the container. The closure body has a dispensing orifice and a sealing cap. A pair of adjacently spaced living hinges connect the sealing cap to the closure body for movement between an open and a closed position. The closure body and sealing cap have sealing elements that provide a complete peripheral seal between the sealing cap and the closure body when in the closed position. The sealing cap has a camming lug located between the living hinges, and contacting the sealing elements on the closure body without impairing the integrity of the sealing elements, and further provides a snap-action to the movement of the sealing cap from the open to the closed position.

15 Claims, 13 Drawing Sheets

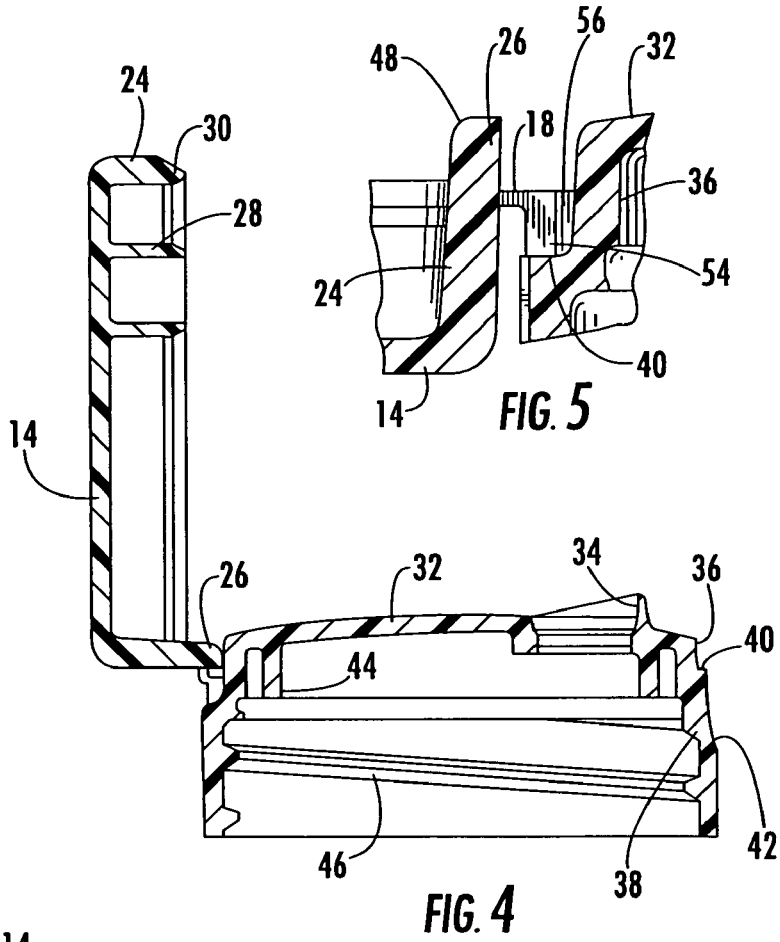
FIG. 4
FIG. 5
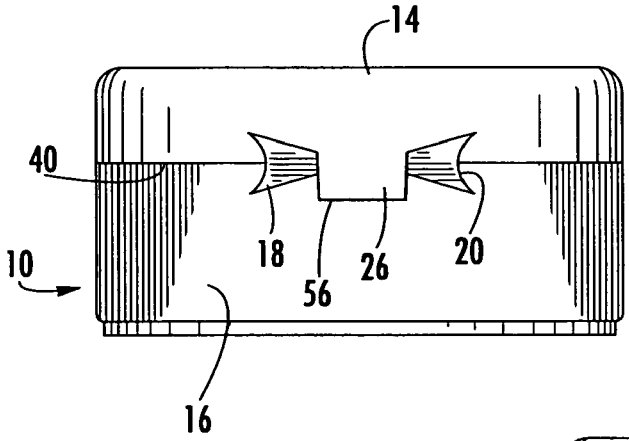
FIG. 6
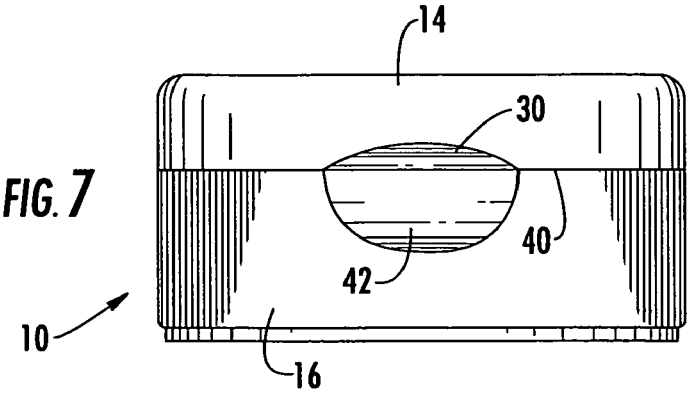
FIG. 7

DISPENSING CLOSURE HAVING COMPLETE PERIPHERAL SEAL

CROSS-REFERENCE TO RELATED APPLICATIONS

This application is related to and claims priority from earlier filed U.S. Provisional Patent Application No. 60/509,523, filed Oct. 9, 2003, and earlier filed U.S. Provisional Application No. 60/587,518, filed Jul. 13, 2004. These documents are incorporated herein by reference.

BACKGROUND OF THE INVENTION

Dispensing containers are used in a variety of industries for the dispensing of various liquid products. For example, in the beauty industry, products such as shampoo, conditioner, creams and lotions are all packaged in flexible containers having a dispensing closure mounted thereon. Such dispensing containers are also used in the food industry for various condiments, such as ketchup, mayonnaise, and syrups.

One important aspect to the mounting of a dispensing closure in the food industry is sealing of the closure immediately after filling. After filling, containers for products, such as syrup, are often subjected to warm water baths to wash away excess product, dust, and the like, and may be further subjected to cooling baths to cool product that is filled while hot. For example, chocolate syrup is filled into the containers at a temperature of about 180° F. After filling, the dispensing closure is mounted onto the container while the product is still hot, and the container is run through a warm bath to wash of excess product that may have spilled onto the outside of the container. The container can thereafter be run through a cooling bath to cool the container to a suitable temperature for further processing. After filling of the container and mounting of the dispensing closure, it is imperative to keep the interior head space of the dispensing closure clean so as to present an aseptic and sterile appearance to the end consumer when opened. In the past, it had been found that rinsing water often infiltrated the seal of the cap on the closure leaving behind residue inside the cap.

To remedy the problem several manufacturers have provided drain openings around the periphery of the cap so that the water can drain out quickly after rinsing. However, this promotes the infiltration of water into the head space, and can actually result in increased levels of residue inside the cap.

Other manufacturers have attempted to keep the water out by providing a complete seal around the cap. However, there has always been a weak spot in the seal in the vicinity of the cap hinge. It is generally known that as the volume of air inside the head space of the cap begins to cool, the air volume shrinks, and creates a small vacuum that tends to draw water inwardly into the interior of the cap.

Another aspect to mounting of dispensing closures is alignment of the dispensing spout with respect to the shape of the container onto which the dispensing closure is mounted. It has been an engineering challenge to provide dispensing closures having a spout that aligns perfectly with the container shape when mounted in a robotic filling line environment. One remedy to the alignment issue has been to place the dispensing orifice at the exact center of the dispensing closure. However, this forces changes in the hinge structure of the cap thus creating external alignment issues with respect to the orientation of the hinges.

It is thus imperative to provide a dispensing closure with a complete peripheral seal around the outer circumference so that no water can infiltrate into the head space of the cap during processing, particularly during cooling, and to provide a dispensing closure that is universally oriented with respect to the shape of the plastic container onto which it is mounted.

SUMMARY OF THE INVENTION

The closure of the present invention obviates such problems in an efficient, low-cost fashion through use of a molded single-piece plastic construction with integrally molded living hinges and dual complete peripheral seals. By incorporating a sealing bead on a sealing cap and a sealing bead on an annular sealing surface of the closure body, the sealing beads prevent the infiltration of water into the sealing cap during the manufacturing process and thus provides an aseptic and sterile appearance to the end consumer when opened. The sealing beads also have the added benefit of providing an audible and tactile click operation to the dispensing closure, informing consumers that the dispensing closure is fully closed and sealed.

Another object of the invention is to provide a dispensing closure that has a snap-action sealing cap. This feature also being seen as desirable by consumers.

Yet another object of the invention is to provide a dispensing closure that does not have to be orientated during assembly onto the container to align the hinges of the sealing cap or to orient the dispensing orifice in a particular direction. This invention accomplishes both goals through use of a low-profile hinge structure that mates to the closure body during manufacturing and has a centrally placed dispensing orifice obviating the need for expensive equipment to align and position the dispensing closures prior to or during assembly onto containers.

Other advantages and features of the present advantage will become apparent in the drawings and detailed description.

BRIEF DESCRIPTION OF THE DRAWINGS

FIG. 4 is a vertical cross-sectional view of the dispensing closure with the sealing cap pivoted to its vertically oriented, opened position;

FIG. 5 is a fragmentary vertical cross-sectional view of the camming lug on the sealing cap that cooperates with a rigid wall on the closure body, such view being taken on an enlarged scale;

FIG. 6 is a rear elevational view of the dispensing closure showing the hinges that join the sealing cap to the closure body;

FIG. 7 is a front elevational view of the dispensing closure showing the gripping surfaces that allow the user to open the dispensing closure;

DETAILED DESCRIPTION OF THE PREFERRED EMBODIMENTS

Figure 1:
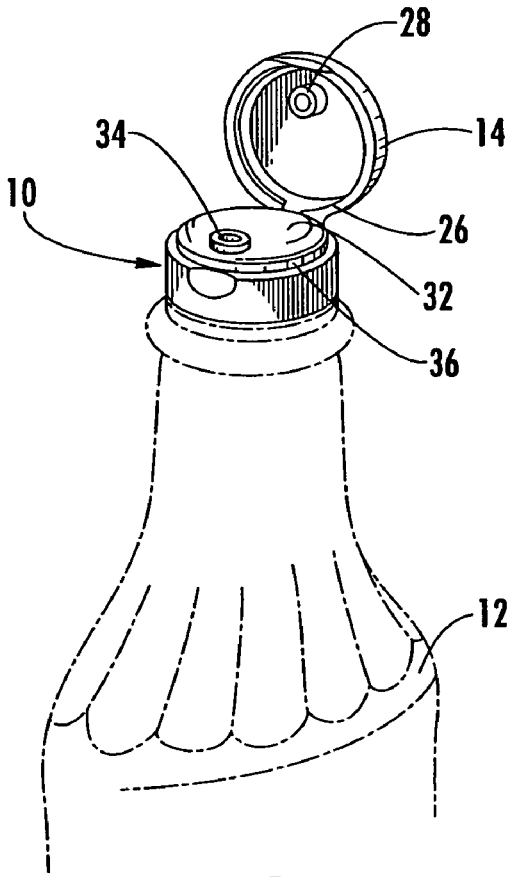
FIG. 1 is a perspective view of a first dispensing closure, constructed in accordance with the principles of the instant invention, applied to a container.

Referring now to the drawings, FIG. 1 depicts a first embodiment of a dispensing closure constructed in accordance with the principles of the invention. The dispensing closure is generally identified at 10, and is shown secured to the upper end of the neck of container 12. Container 12 may assume the form of a plastic bottle, which may be tilted, and squeezed, to discharge its contents through closure 10.

Figure 2:
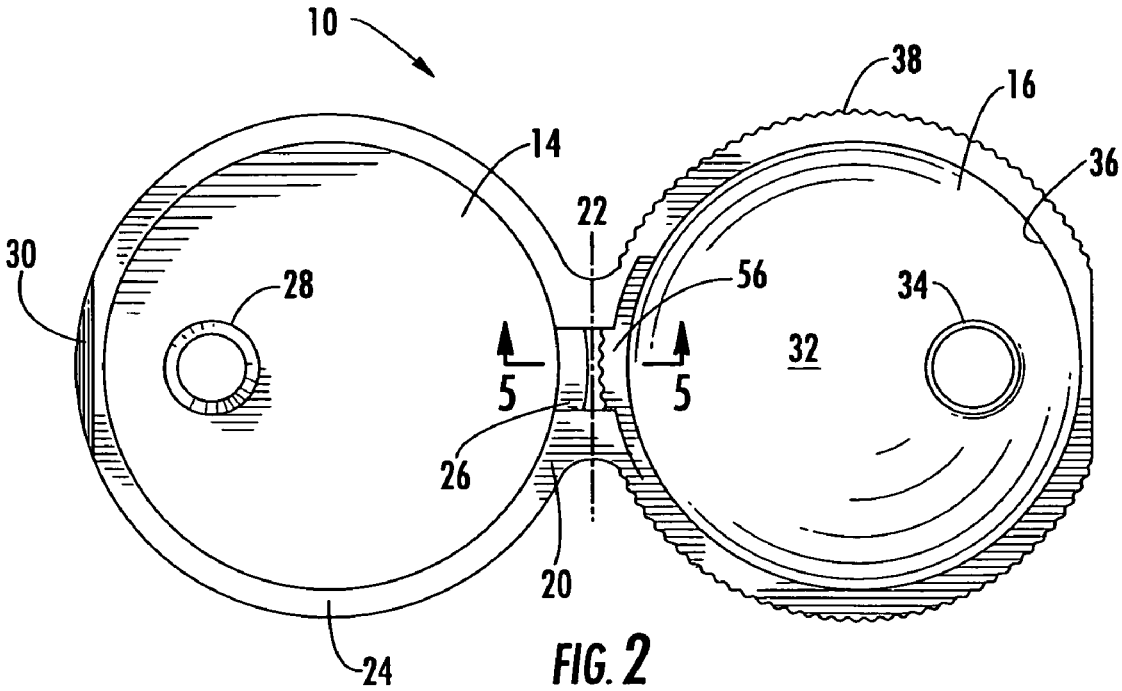
FIG. 2 is a top plan view of the dispensing closure, on an enlarged scale, such view showing the dispensing closure in its as-molded condition.

FIG. 2 shows dispensing closure 10 in its as-molded condition, prior to its securement to container 12. Closure 10 comprises sealing cap 14, a closure body 16, and a pair of hinges 18, 20 that join the sealing cap to the closure body. Sealing cap 14 is pivoted along the center line 22 of the hinges relative to closure body 16.

Figure 3:
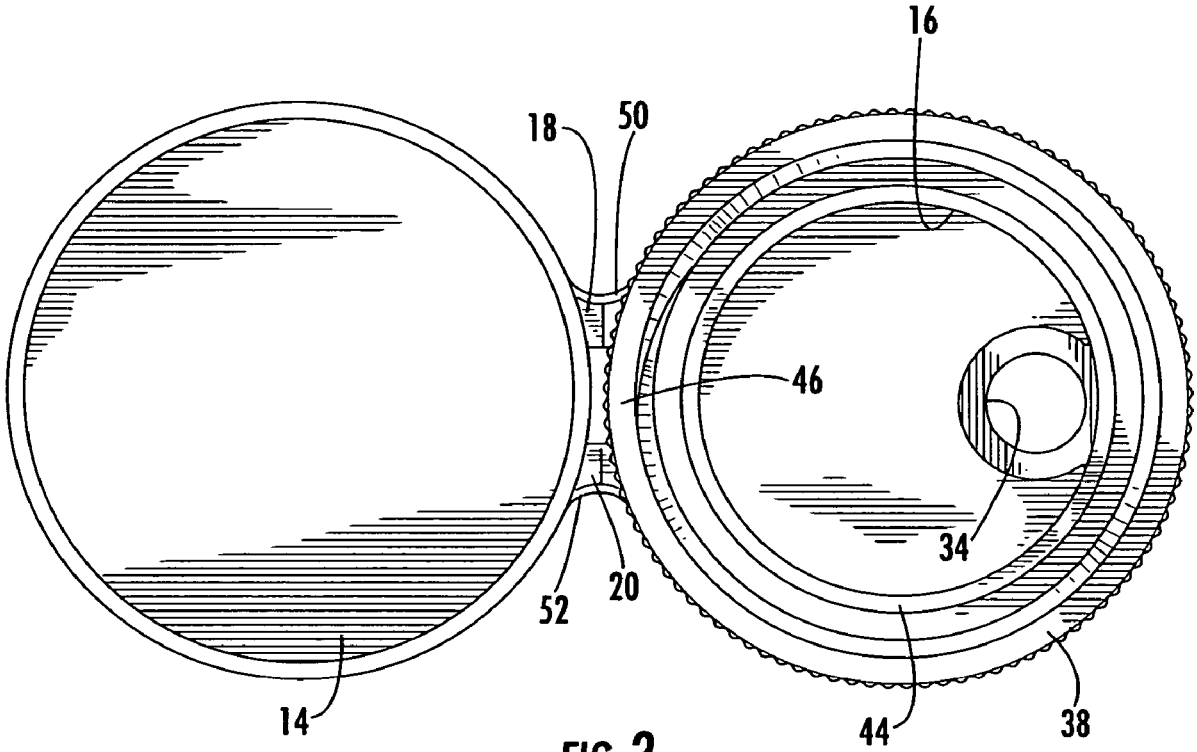
FIG. 3 is a bottom plan view of the dispensing closure of FIG. 2.

Sealing cap 14, as shown in FIGS. 2 and 3, includes an annular flange 24, a camming lug 26 located on flange 24 in proximity to closure body 16, and a depending peg 28. Camming lug 26 is curved, when viewed from above, and follows the contour of flange 24. Flange 24, remote from camming lug 26, is reduced in thickness to form gripping surface 30.

Closure body 16 includes a smooth upper wall 32 interrupted by dispensing orifice 34; the dispensing orifice communicates with the interior of the closure body. An annular sealing surface 36 is located below upper wall 32, and encircles closure body 16, and skirt 38 below the upper wall 32. Horizontal ledge 40 is formed between annular sealing surface 36 and skirt 38. An indentation 42 is formed in the exterior surface of skirt 38 at a location remote from hinges 18, 20, and in alignment with camming lug 26.

Locator ring 44 depends below upper wall 32 into the interior of closure body 16, and internal threads 46 are arranged in helical fashion around the interior of skirt 38. Ring 44 engages the end of the neck of container 12 to which dispensing closure 10 is applied, while threads 46 cooperate with complementary threads, or lugs, on the neck of the container 12 to secure dispensing closure 10 in fixed position.

FIGS. 2 and 3 show a dispensing closure, which is a unitary molding, in its as-molded condition, as it exits the mold. However, prior to use, in order to properly orient the molecular structure of the molded plastic in the area of living hinges 18, 20, sealing cap 14 is pivoted 180 degrees to its closed position. The sealing cap 14 as in FIGS. 6 and 7 indicates the position into which sealing cap 14 is pivoted to achieve the desired molecular orientation. Hinges 18, 20 are thin, resilient plastic members that are deformed repeatedly over the useful life of the dispensing closure, so that sturdy, durable hinges are necessary for successful operation.

Camming lug 26 as shown in FIG. 5, extends beyond flange 24. Consequently, when sealing cap 14 is pivoted to the upright position (shown in FIG. 4), camming lug 26 engages, and slides along annular sealing surface 36 on closure body 16. The interference between camming lug 26 and annular sealing surface 36 stresses hinges 18, 20, and aligns the molecular structure of the plastic within the hinges. Edge 48 of camming lug 26 is rounded so that the camming lug does not gouge annular sealing surface 36, an important consideration since sealing cap 14 is pivoted to its closed position shortly after removal from the mold. Rounded edge 48 also enhances the snap-action of sealing cap 14.

Camming lug 26 is strategically located between spaced hinges 18, 20, for effectively stressing same within their elastic limits. The hinges may be strengthened, if warranted, by the addition of reinforcing ribs 50, 52. The ribs are visible in FIG. 3, and conform to the contour of the exterior edges of the hinges. The gap between sealing cap 14 and closure body 16, that is spanned by hinges 18, 20, is also visible.

Hinges 18 and 20 are each integrally formed with a holder. Holder 54 for hinge 18 is shown in FIG. 5, and a similar holder (not shown) is formed with hinge 20. In order to impart a limited degree of resiliency to holder 19, an arcuate recess 56 is removed from skirt 38 in the vicinity of the hinges and camming lug 26. The size and shape of segment 56 is shown in FIG. 2.

Recess 56 imparts resiliency to holder 54 for hinge 18, and does the same for the holder for hinge 20. The limited resiliency of the holders for hinges 18, 20 permits some relaxation of the close tolerances associated with dispensing closures, without sacrificing desirable operational characteristics.

As shown in FIG. 6, recess 56 receives camming lug 26 when sealing cap 14 is swung into sealing engagement with closure body 16. Flange 24 of sealing cap 14 contacts ledge 40 to form a snug seal about the circumference of ledge 40. The inner surface of flange 24 contacts annular sealing surface 36 to further enhance the efficiency of the sealing action, which keeps water and/or other fluids from reaching the interior of the closed dispenser closure. Additionally, dispensing closure 10, when closed, assumes a compact, or low, profile.

FIG. 7 shows gripping surface 30 on sealing cap 14 in relationship to indentation 42 on skirt 38 of closure body 16. Surface 30 and indentation 42 cooperate to allow the user of the cap to insert his finger beneath sealing cap 14 and manually lift same. After the sealing cap is pivoted partially toward its vertical, or opened position, camming lug 26, in concert with hinges 18, 20 imparts a snap-action to the sealing cap. Sealing cap 14 is retained in its vertical position by camming lug 26 pressing against annular sealing surface 36 on the closure body, in opposition to the forces imparted by hinges 18 and 20, as shown in FIG. 4.

Closure 10, as shown in FIGS. 1-7 and as described in the foregoing specification, realizes several advantages over known dispensing closures. To illustrate, the significant sealing area defined between flange 24 and ledge 40, as well as the back-up seal between the surface of annular sealing surface 36 and flange 24, allows the closure to be used on food products, such as ketchup, syrups, and the like. After filling, containers, for such products, such as flexible plastic bottles, are subjected to warm water baths to wash away excess product, dust, and the like. Such warm water baths have occasionally left droplets of water behind—an unsightly proposition that offends the ultimate user and may even pose a minor health hazard. Closure 10, as presently configured, obviates such problem in an efficient, lowcost fashion.

Furthermore, the use of pair of spaced hinges 18, 20, has materially increased the resistance of closure 10 to twisting forces. Such forces come into play as automated capping machinery applies torque to the closure to screw same onto the neck of a container or if consumers twist the closure to remove it from the neck of the container.

Hinges 18 and 20 are folded when sealing cap 14 is engaged, in sealing relationship, with closure body 16. As shown in FIG. 6, the folded hinges project outwardly a small distance from the closure body, and do not interfere with the sealing engagement of flange 24 and ledge 40, and/or with the interior surface of flange 24 and annular sealing surface 36. Also, closure 10 is aesthetically pleasing, with a slightly curved upper wall 32 on closure body 16, such wall being unbroken except for dispensing orifice 34. The manner in which camming lug 26 fits into recess 56 when sealing cap 14 is closed, is also pleasing to the eye, and precludes accumulation of excess food product, and/or dire, after discharge from container 12.

Figure 8:
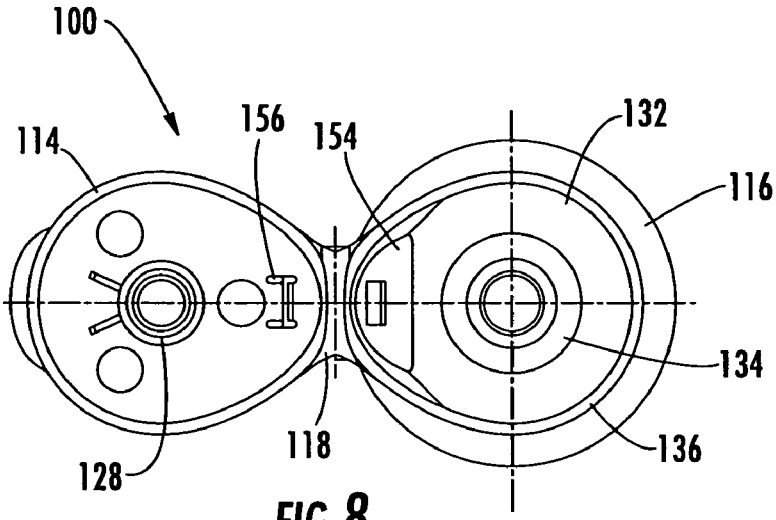
FIG. 8 is a top plan view of an alternative embodiment of the invention wherein the dispensing spout, i.e. orifice has been moved to the central axis of the closure.

Referring now to FIG. 8, an alternative closure generally indicated at 100 comprises a sealing cap 114 and a closure body 116 connected by hinge 118. The closure 100 generally has a taller configuration and the dispensing orifice 134 is centered on the closure body 116. the dispensing orifice 134 is composed a narrower upper channel 134*a* and a wider lower channel 134*b* to employ fluid dynamic principles to minimize spillage of the contents after the consumer dispenses the desired amount of product.

Sealing cap 114 is pivoted about the hinge between an open and closed configuration. Closure body 116 is provided with deck 132 and dispensing orifice 134 centrally located and extending upwardly from deck 132. Extending about the full circumference of the deck is sealing surface 136. Located inwardly of this sealing surface is rib 152 and recess 154.

Figure 9:
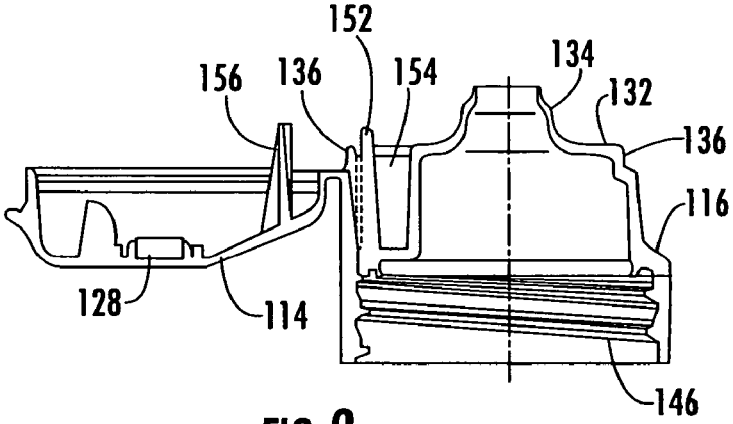
FIG. 9 is a cross-sectional view with the cap in the open position.

The structure of the sealing cap can also be seen in the cross-sectional view of FIG. 9. As can be seen, the sealing cap 114 is provided with a plug 128 that cooperates with dispensing orifice 134. Extending from the sealing cap is a peripheral skirt that cooperates with the sealing surface 136. Extension 156 extends from the underside of the sealing cap 114 and whose function will be described later. As can be seen, the closure has threads 146 for attaching the closure to the neck of a bottle.

Figure 10:
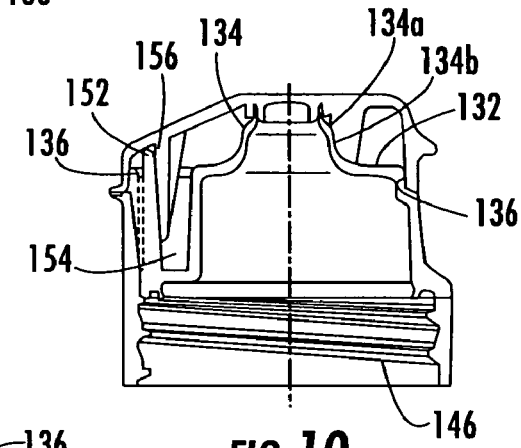
FIG. 10 is a cross-sectional view with the cap in the closed position.

FIG. 10 shows an enclosed configuration of the closure. Clearly seen is the plug 128 in engagement with the dispensing orifice 134. Also, the seal between the skirt of the sealing cap and the annular sealing surface 136 is completely seen, including the seal immediately adjacent the hinge. The seal between the skirt and annular sealing surface 136 extends about the entire periphery of the deck. As can be seen in this figure as well, is the placement of the extension 156 into the recess 154. As can be seen, while closing the sealing cap, rib 152 and extension 156 come into direct contact, providing a camming action when the sealing cap is opened and closed.

Figure 11:
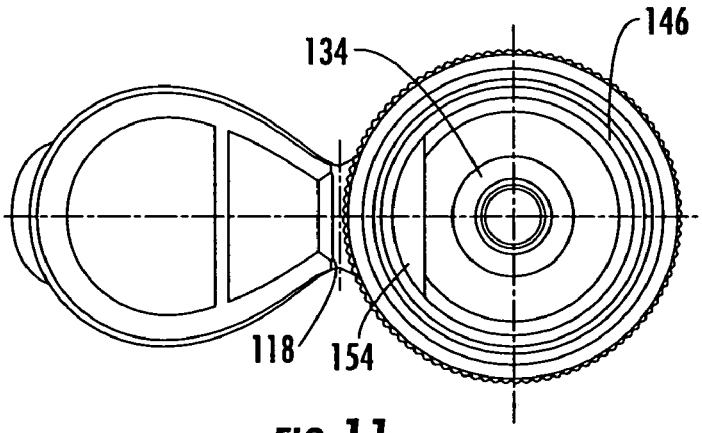
FIG. 11 is a bottom view of the closure with the cap in the open position.
Figure 12:
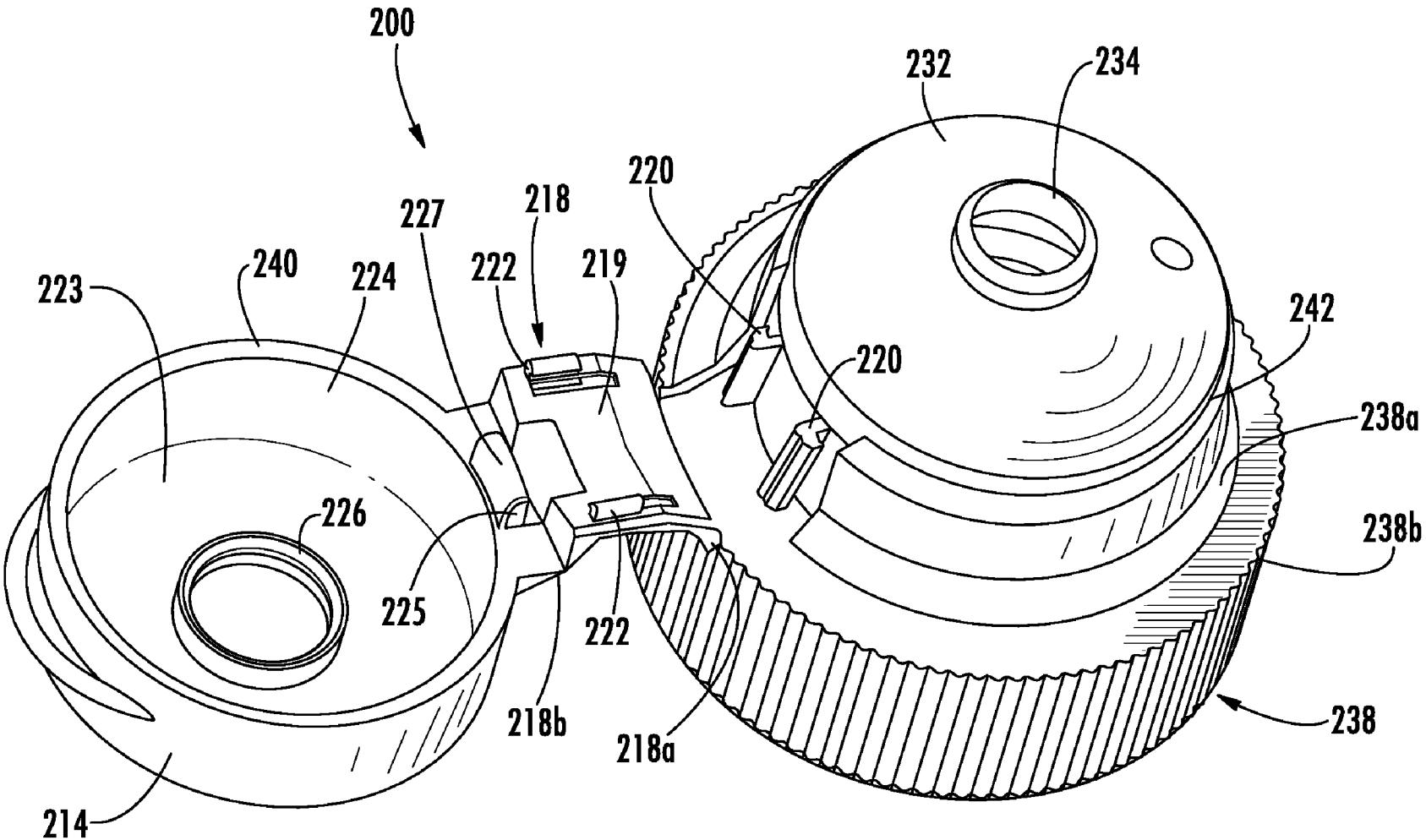
FIG. 12 is a perspective of a third and most preferred embodiment of the invention showing the cap in its as-molded condition.
Figure 13:
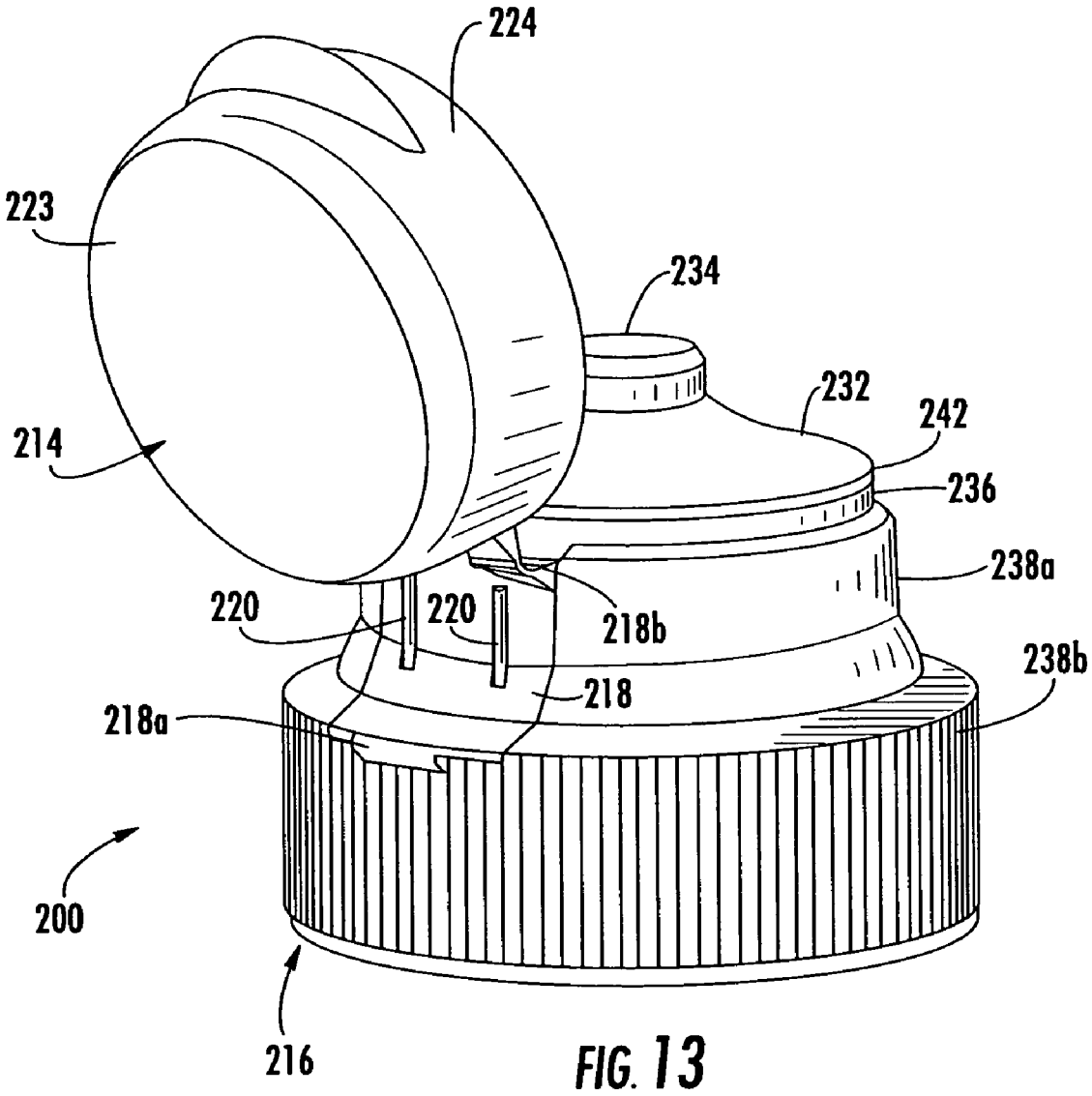
FIG. 13 is another perspective view thereof showing the cap in an intermediate position with the hinge arm locked onto the body of the cap.
Figure 14:
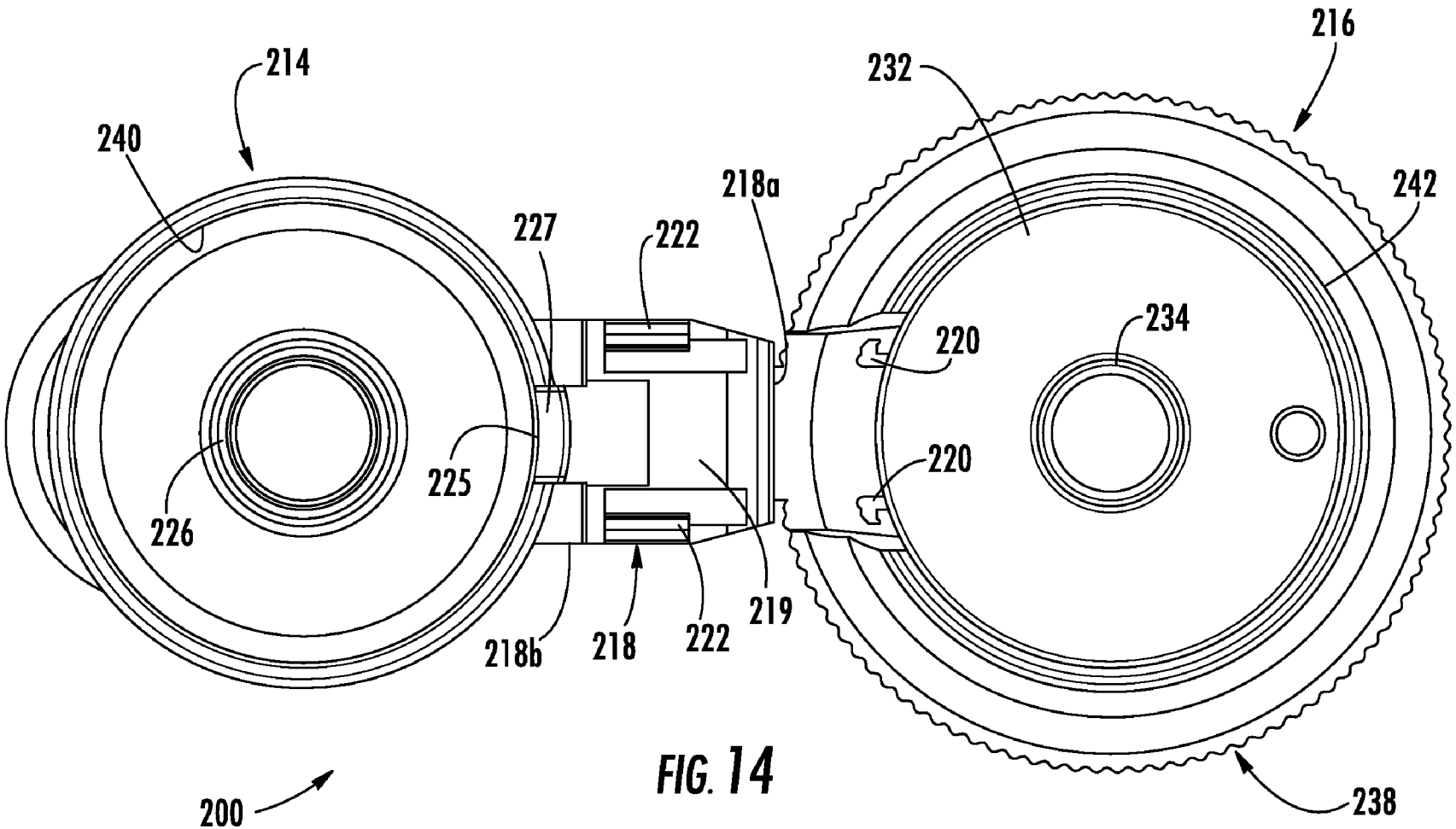
FIG. 14 is a top plan view thereof.

FIG. 11 shows the bottom side of the closure. As can be seen, the bottom of recess 154 does not interfere with the dispensing of contents through dispensing orifice 134 or the engagement of threads 146 onto a container.

FIGS. 12-19 illustrates a third and most preferred embodiment of the invention that combines all of the valued features of the earlier described embodiments, such as low profile hinge structure, symmetrical outer body structure, centrally positioned dispensing orifice, and complete peripheral seals. Similar to the embodiment in FIGS. 8-11, the dispensing orifice 234 is centrally aligned along the central axis of the closure body 216. However, the hinge structure 218 is modified so as to blend into the peripheral skirt 238 of the closure body 216, obviating the need to orient the closure 200 when mounted on a container 12.

The closure is generally indicated at 200 and comprises a sealing cap 214 and a closure body 216 integrally connected by a hinge structure 218 having two living hinges 218*a* and 218*b*.

The closure sealing cap 214 includes an upper wall 223, annular flange wall 224 depending downwardly from the upper wall 223, and a central sealing bead 226 depending downwardly from the center of the upper wall 223.

Adjacent to the hinge 218b and depending from the annular flange wall 224 of the sealing cap 214, is a camming lug 225 having a rounded edge 227. Camming lug 225 extends beyond the annular flange wall 224 and functions similarly to the camming lug 26 shown in F*ig*.4 and described earlier of the first embodiment. Accordingly, when sealing cap 14 is pivoted to the upright position, camming lug 225 engages and slides along annular sealing surface 236 on the closure body 216. The edge 227 of the camming lug 225 is rounded so that the camming lug 225 does not gouge annular sealing surface 236. The rounded edge 227 also enhances the snap-action of sealing cap 214.

The closure body 216 has an upper wall 232 including a centrally positioned dispensing orifice 234, an annular sealing surface 236, an upper peripheral skirt 238*a* and a lower peripheral skirt 238*b*.

The sealing cap 214 is connected to the closure body 216 by a hinge structure 218 that is specifically designed to form a low profile when snapped into position. The living hinge 218 includes a hinge body 219 having a body hinge 218*a* adjacent to the closure body 216 and a sealing cap hinge 218*b* adjacent to the sealing cap 214. The hinge body 219 and the upper peripheral skirt 238*a* of the closure body 216 are provided with interfitting mating formations 220 and 222 that snap together when the hinge body 219 is rotated about the body hinge 218*a*. More specifically, the formations 220 and 222 comprise two hook-shaped tabs 220 in the surface of the upper peripheral flange 238*a* and two complimentary receiving tabs 222 on the hinge body 219. However, other similar configurations are possible. The intention of the hinge structure 218 is to provide a low profile, substantially flush engagement when snapped into position. In the as molded configuration, the closure body 216, hinge structure 218, and sealing cap 214 are laid out flat (See FIGS. 12, 14, 15, and 18). Upon removal from the mold, the hinge body 219 is pivoted about the body hinge 218*a* so that the sealing cap hinge 218*b* is positioned in proximity to the upper wall 232 of the closure body 216, with the sealing cap oriented 90 degrees relative to the upper wall of the closure body (see FIG. 13).

The sealing cap hinge 218*b* has a similar configuration to the hinge tab structure 26 shown in FIG. 4, and is movable between an open position (FIG. 13) and a closed position (not fully shown). When the sealing cap 214 is moved into the fully closed position the sealing bead 226 encircles and engages the outer walls of the dispensing orifice 234 to seal the dispensing orifice 234 at the opening.

Referring back to FIG. 12, the dispensing closure 200 is shown in its as-molded condition. Therefore hinges 218*a*, 218*b* are formed in a 90 degree open configuration and contrary to industry practice of forming living hinges in a 180 degree open or flat configuration.

To provide a complete peripheral seal around the upper wall 232, i.e. to prevent water from infiltrating onto the upper wall 232, the lower edge of the flange wall 224 of the sealing cap 214 includes a continuous peripheral sealing bead 240. When the sealing cap 214 is moved to the closed position, the sealing bead 240 engages the entire circumference of the annular sealing surface 236 to form a continuous primary seal around the circumference of the closure 200. In addition, to form a secondary sealing line, the outer peripheral edge of the upper wall 232 includes a peripheral sealing bead 242 that engages the inner wall of the sealing cap flange 224 when the sealing cap 214 is moved to the closed position.

Figure 19:
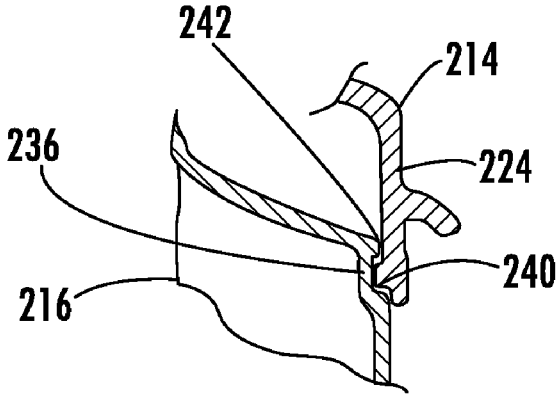
FIG. 19 is an enlarged cross-section view showing the sealing cap in the closure position and the two lines of peripheral sealing between the sealing cap flange and the annular sealing surface.
Figure 17:
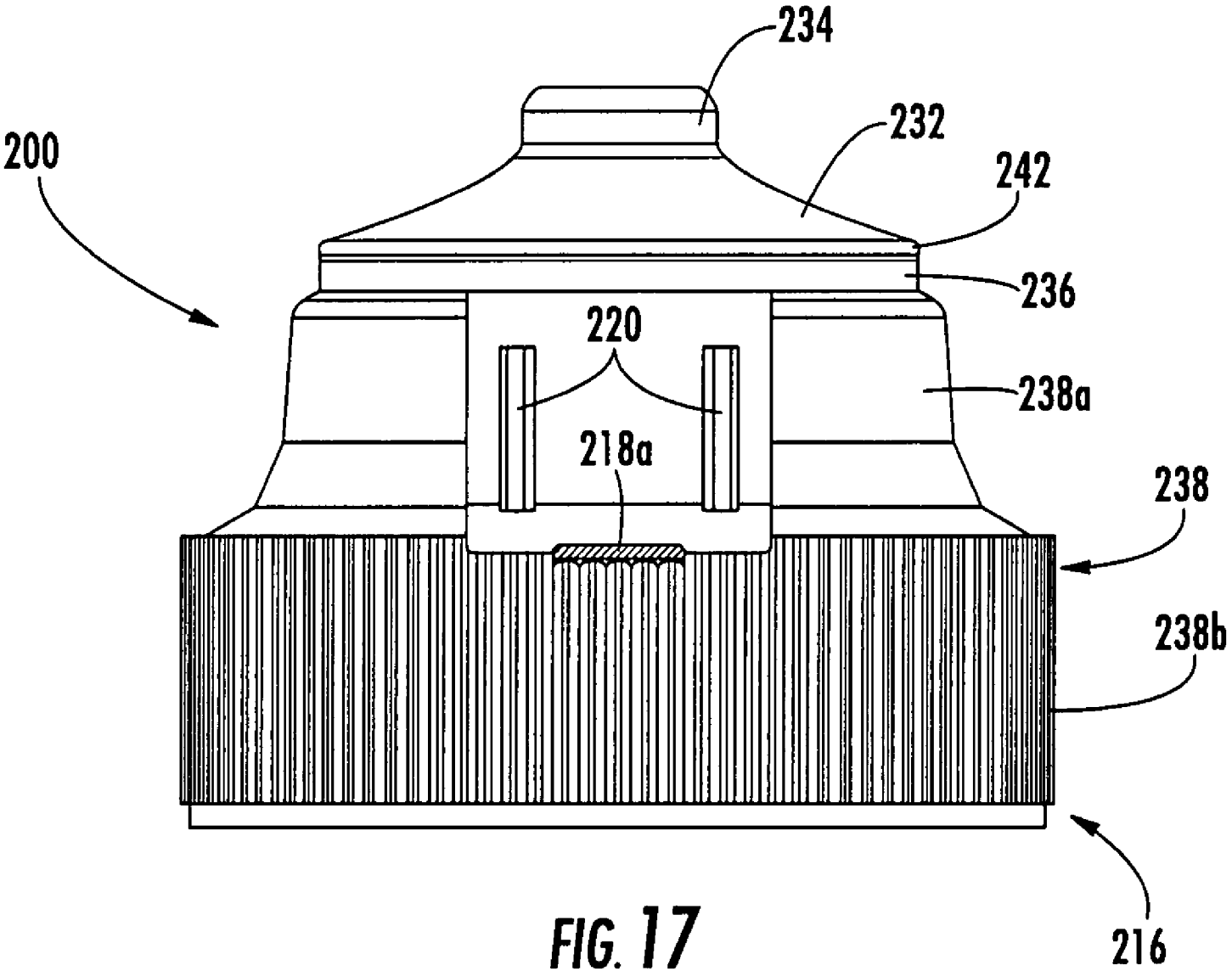
FIG. 17 is a cross-sectional view thereof.

In particular, please refer to FIG. 19, which shows the sealing configuration in better detail.

Figure 15:
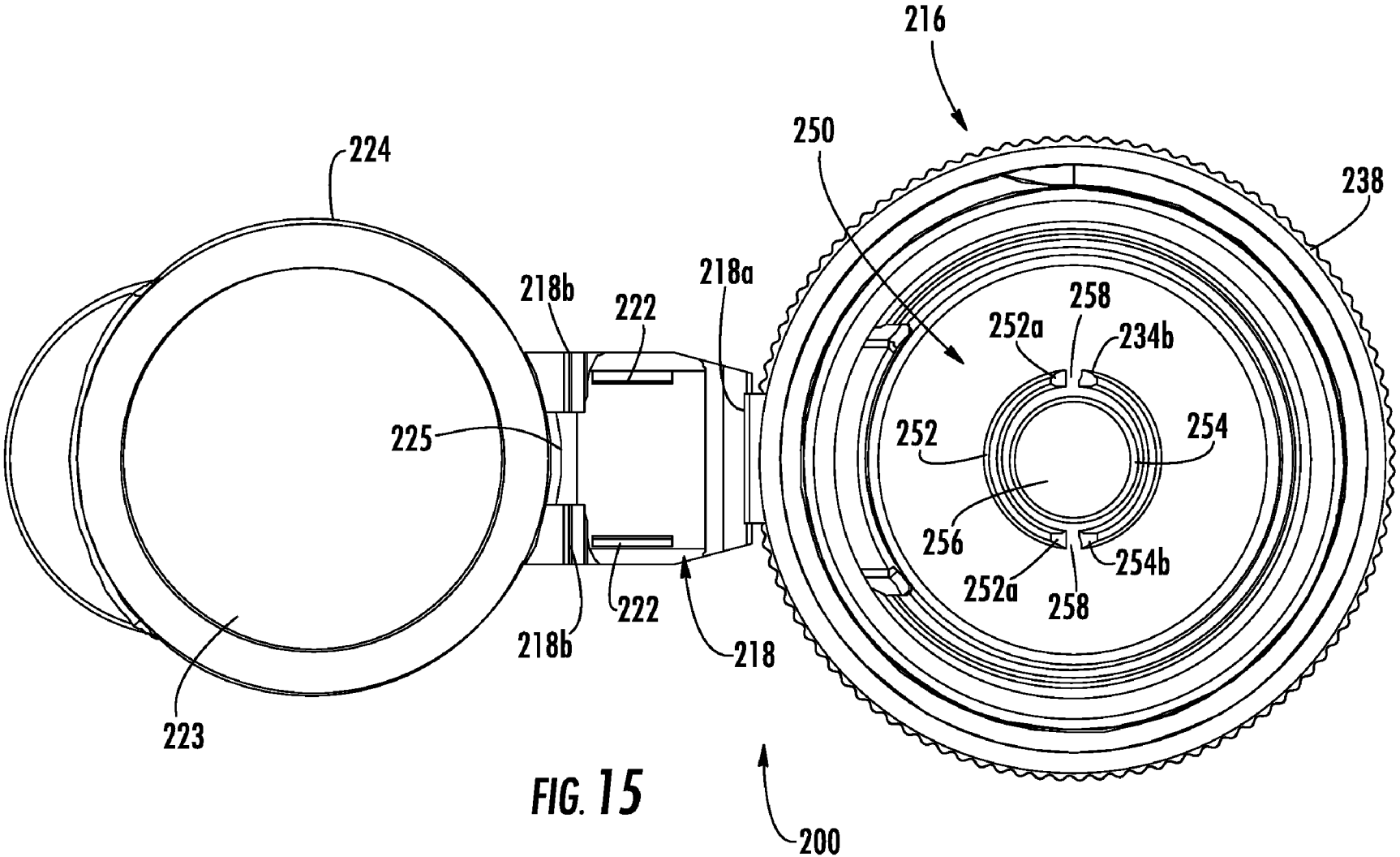
FIG. 15 is a bottom plan view thereof.
Figure 16:
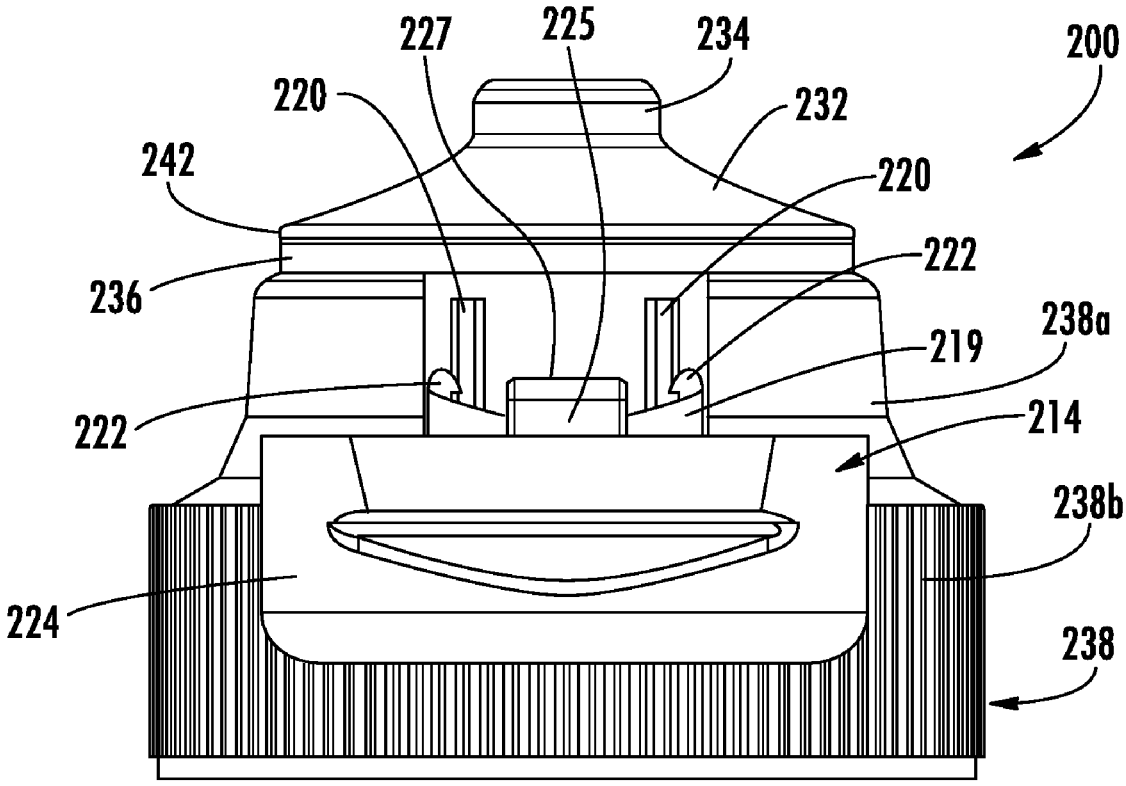
FIG. 16 is a left side plan view thereof.
Figure 18:
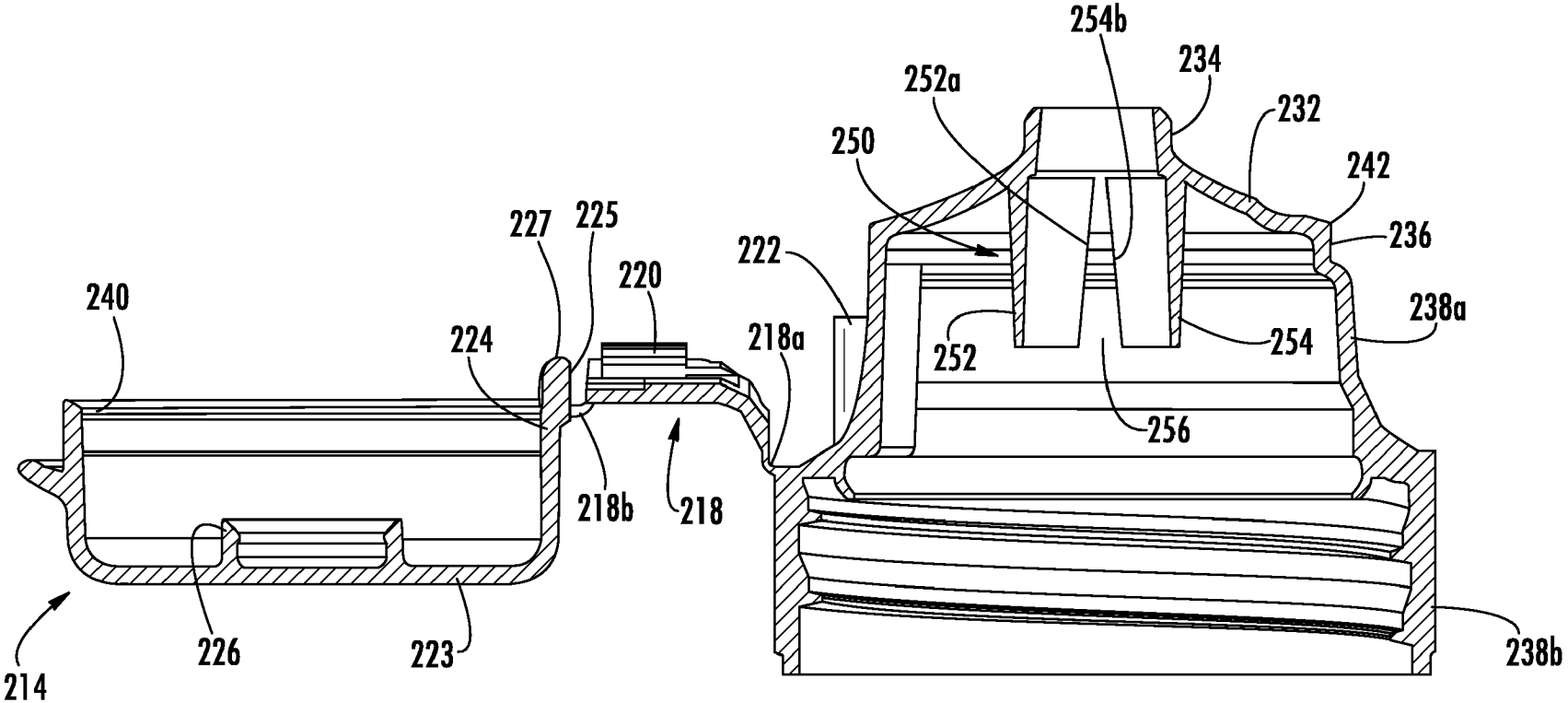
FIG. 18 is another cross-sectional view thereof.

Referring now to FIGS. 15 and 18, depending from the inside surface of the upper wall 232 and surrounding the dispensing orifice 234 is a flow modulator 250. The flow modulator 250 has two spaced-apart flow walls 252, 254 that are configured to face each other and form a channel 256. The flow walls 252, 254 have two restriction edges 252*a*, 254*b* that taper inwardly towards one another to form two relief openings 258 that are generally V-shaped. The function of the flow modulator 250 is to provide added restriction to the flow of a viscous fluid through the dispensing orifice and to prevent spillage of the fluid onto the outside surface of the upper wall 232.

Figure 20:
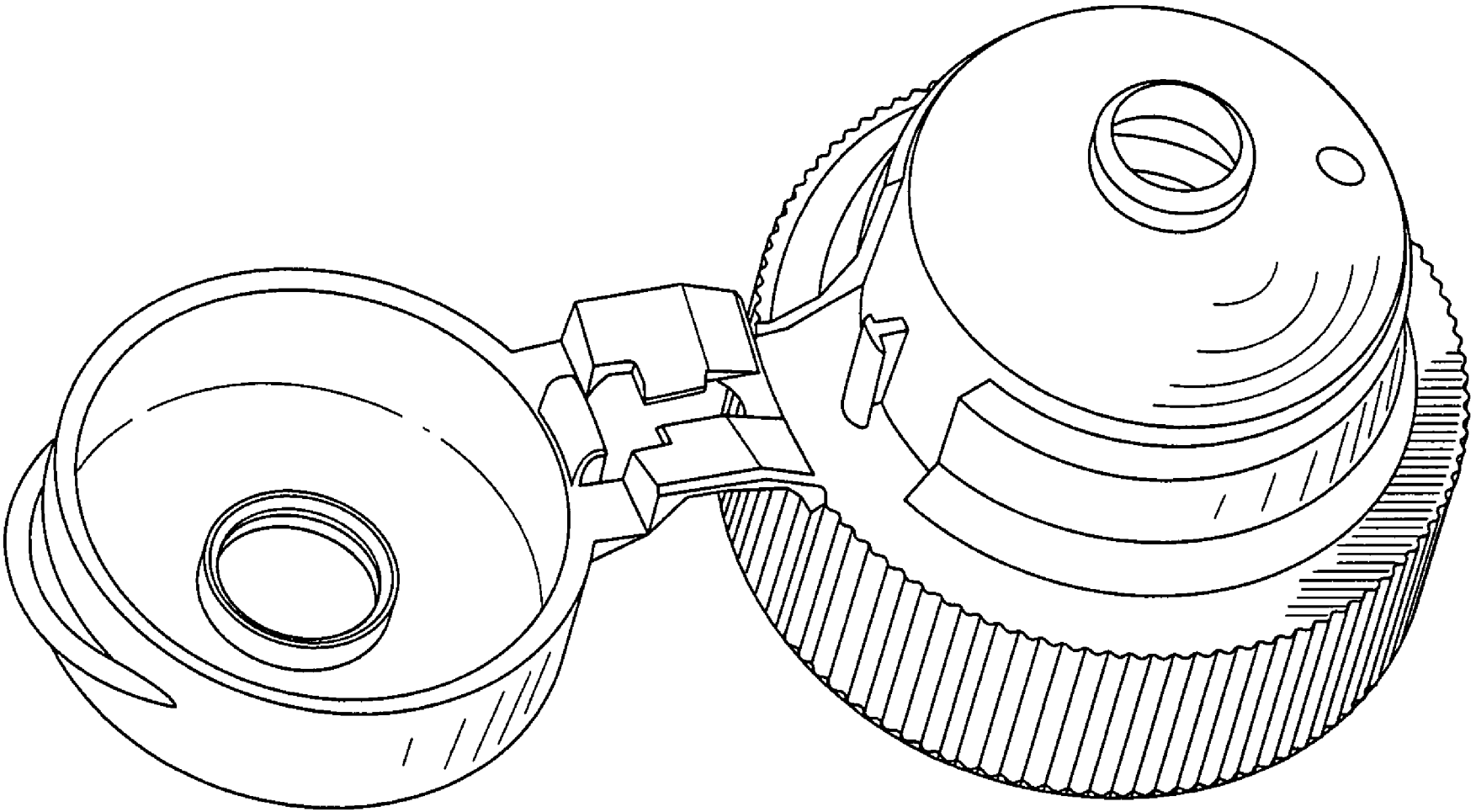
FIG. 20 is a perspective view of a fourth embodiment.
Figure 21:
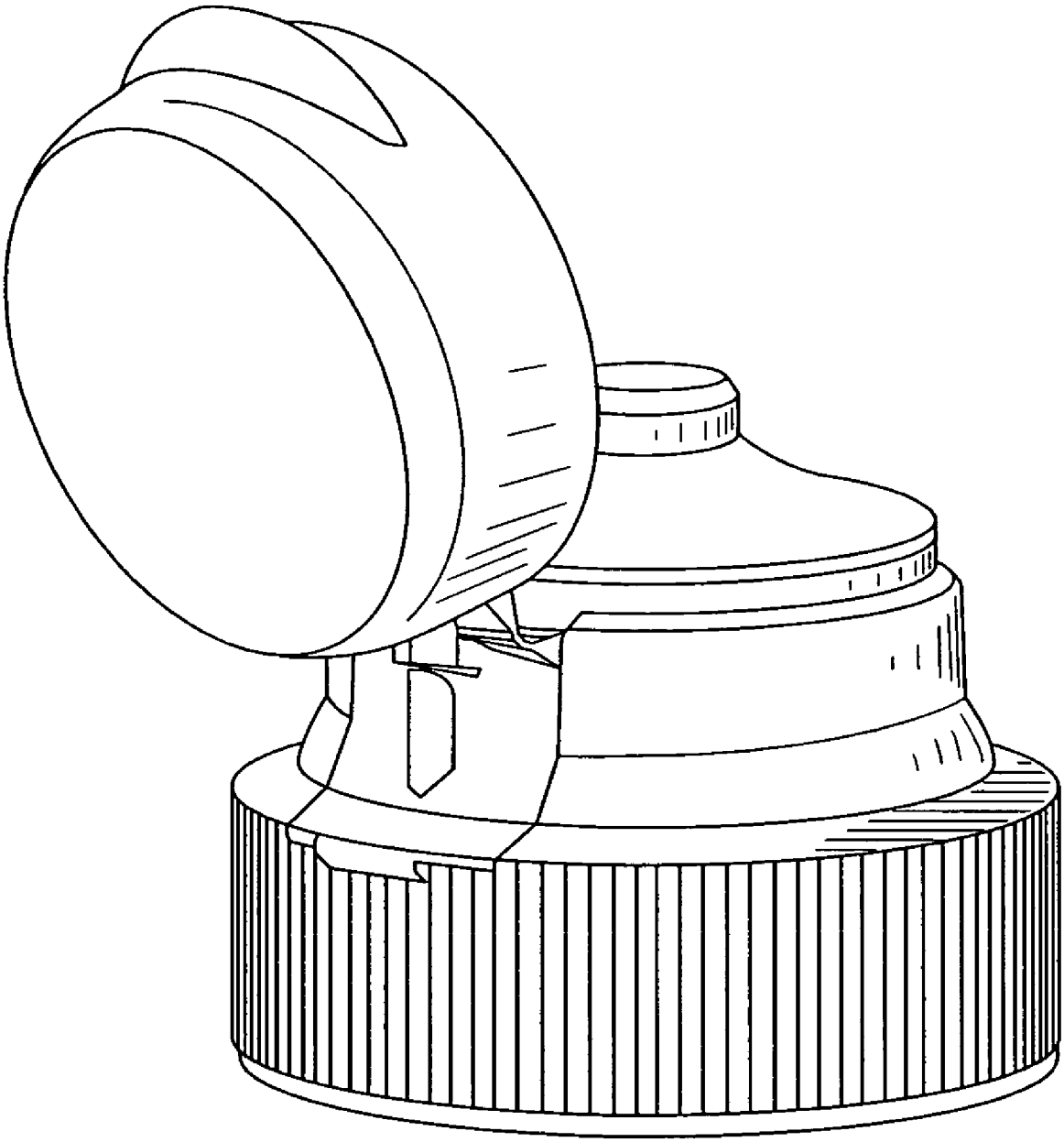
FIG. 21 is another perspective view of the fourth embodiment.

FIGS. 20 and 21 show an alternative embodiment for the configuration of the instant invention at 300. In particular, the interfitting mating formations comprise a T-shaped tab 320 located on the upper peripheral flange 338*a*, and a complimentary slot 322 located on the hinge body 319.

Although the present invention has been described in considerable detail with reference to certain preferred embodiments thereof, other versions are possible to those with ordinary skill in the art. For example, other means could be used to attach the closure to the container other than screw threads, such as a snap-rim. Also, other arrangements of the interfitting mating formations could be used to anchor the hinge body to the upper peripheral skirt. Therefore, the scope of the appended claims should not be limited to the description of the preferred embodiments contained herein.

What is claimed is:

1. A dispensing closure for a container comprising:

a closure body adapted to be mounted on the container, the closure body having a dispensing orifice, a sealing cap for the closure body, a pair of adjacently spaced living hinges connecting the sealing cap to the closure body for movement between an open and a closed position, the closure body and sealing cap having cooperable engageable sealing means providing an uninterrupted complete peripheral seal between the sealing cap and the closure body when in the closed position, and a camming lug located on the sealing cap and between the living hinges, and contacting the sealing means on the closure body without impairing the integrity of the sealing means, providing a snap-action to the movement of the sealing cap from the open to the closed position.

2. The dispensing closure of claim 1 wherein the sealing means comprises an annular sealing surface on the closure body having a primary sealing bead on the upper portion thereof, and a secondary sealing bead on the sealing cap such that when the sealing cap is in the closed position the primary sealing bead forms a complete peripheral seal against the sealing cap, and the secondary sealing bead forms a complete peripheral seal against he annular sealing surface; and the camming lug contacting the annular sealing surface in the open position.

3. A dispensing closure for a container comprising:

a closure body adapted to be mounted on the container, the closure body having a tapered end and having a dispensing orifice thereon, the tapered end being smaller in diameter than the closure body;

a sealing cap for the closure body of the same diameter as the tapered end of the closure body;

a hinge structure connecting a sealing cap to the closure body for movement between an open and a closed position, the closure body and sealing cap having cooperable engageable sealing elements providing an uninterrupted complete peripheral seal between the sealing cap and the closure body when in the closed position, and a camming lug located on the sealing cap and within the hinge structure, and contacting the sealing elements on the closure body without impairing the integrity of the sealing elements, providing a snap-action to the movement of the sealing cap from the open to the closed position.

4. The dispensing closure of claim 3 wherein the hinge structure comprises:

a hinge body connected to the closure body with a living hinge and to the sealing cap with a pair of adjacently spaced living hinges; and a pair of mating formations to hold the hinge body against the tapered end of the closure body providing a low-profile and substantially flush surface.

5. The dispensing closure of claim 3 wherein the sealing elements comprise an annular sealing surface on the closure body having a primary sealing bead on the upper portion thereof, and a secondary sealing bead on the sealing cap such that when the sealing cap is in the closed position the primary sealing bead forms an uninterrupted complete peripheral seal against the sealing cap, and the secondary sealing bead forms a complete peripheral seal against he annular sealing surface; and the camming lug contacting the annular sealing surface in the open position.

6. A dispensing closure for a container comprising:

a closure body including an upper wall having a dispensing orifice, a side wall depending from said upper wall, and an annular skirt depending from said side wall, said skirt being configured to be mounted to a container;

a sealing cap having an upper wall and a flange depending from said upper wall;

a living hinge structure pivotably joining said sealing cap to said closure body, said sealing cap being pivotably movable about said hinge structure between an open and a closed position, a sealing element providing an uninterrupted complete peripheral seal between an outer sealing surface of said side wall of said closure body and an inner surface of said flange of said sealing cap when said sealing cap is in said closed position;

a camming lug depending from said flange in proximity to said closure body and positioned adjacent said hinge structure, said camming lug having a terminal end engaging said outer sealing surface of said side wall and being slidably movable relative to said sealing surface when said sealing cap is moved between said open and closed positions and providing a snap-action movement relative to said sealing surface without impairing the integrity of said sealing surface.

7. The dispensing closure of claim 6 wherein said sealing element comprises an annular sealing bead formed on said inner surface of said flange, said annular sealing bead engaging said outer sealing surface of said side wall to form an uninterrupted complete peripheral seal.

8. The dispensing closure of claim 7 further comprising a second annular sealing bead formed on said sealing surface of said side wall, said second annular sealing bead engaging said inner surface of said flange to form a secondary uninterrupted complete peripheral seal.

9. The dispensing closure of claim 6 wherein said terminal end of said camming lug is rounded.

10. The dispensing closure of claim 6 wherein said hinge structure comprises a pair of living hinges, and said camming lug is positioned between said pair of living hinges.

11. The dispensing closure of claim 6 wherein said side wall of said closure body and said sealing cap each have a diameter that is smaller than said skirt.

12. The dispensing closure of claim 11 wherein said hinge structure comprises a hinge body, a closure body hinge adjacent to the closure body joining the closure body and the hinge body, and a sealing cap hinge adjacent said sealing cap and joining the sealing cap to the hinge body.

13. The dispensing closure of claim 12 wherein said hinge body is pivotably movable about said closure body hinge from an open position apart from said closure body to a closed position in facing mating relation with said closure body such that said sealing cap hinge is located radially inwardly from an outer peripehral edge of said skirt, said closure body and said hinge body including interfitting mating formations to lock said hinge body in facing mating relation with said closure body.

14. The dispensing closure of claim 12 wherein said sealing cap hinge comprises a pair of living hinges, and said camming lug is positioned between said pair of living hinges.

15. The dispensing closure of claim 13 wherein said sealing cap hinge comprises a pair of living hinges, and said camming lug is positioned between said pair of living hinges.

* * * * *